United States Patent [19]

Allard

[11] Patent Number: 4,714,209

[45] Date of Patent: Dec. 22, 1987

[54] COIL FORMING METHOD

[75] Inventor: Vincent L. Allard, Staines, England

[73] Assignee: BICC Public Limited Company, London, England

[21] Appl. No.: 921,734

[22] Filed: Oct. 20, 1986

Related U.S. Application Data

[63] Continuation of Ser. No. 746,182, Jun. 18, 1985, abandoned.

[30] Foreign Application Priority Data

Jun. 20, 1984 [GB] United Kingdom ..... 8415734

[51] Int. Cl.[4] ..... B65H 54/00; B65H 67/00; B21C 47/02

[52] U.S. Cl. ..... 242/25 R; 242/25 A; 242/78; 242/81; 242/115

[58] Field of Search ..... 242/25 A, 25 R, 18 A, 242/18 R, 41, 78, 81, 110, 110.1, 110.2, 110.3, 115, 116, 1, 7.09, 47

[56] References Cited

U.S. PATENT DOCUMENTS

| | | | |
|---|---|---|---|
| 760,323 | 5/1904 | Edwards . | |
| 1,588,521 | 6/1926 | Brequet et al. | 242/78 |
| 2,149,851 | 3/1939 | MacLeod . | |
| 2,579,700 | 12/1951 | Picton | 242/81 |
| 2,662,701 | 12/1953 | Weber | 242/110 |
| 2,782,809 | 2/1957 | Smallridge | 242/7.09 X |
| 2,829,845 | 4/1958 | Loop | 242/81 |
| 2,971,721 | 2/1961 | Jones | 242/115 X |
| 2,985,401 | 5/1961 | Gazet | 242/81 |
| 3,374,959 | 3/1968 | Tigges | 242/81 X |
| 3,625,448 | 12/1971 | Griffiths | 242/78 |
| 3,729,102 | 4/1973 | Shumaker | 242/81 X |
| 4,518,129 | 5/1985 | Cote et al. | 242/78 |

FOREIGN PATENT DOCUMENTS

| | | |
|---|---|---|
| 87020 | 6/1896 | Fed. Rep. of Germany . |
| 505787 | 8/1930 | Fed. Rep. of Germany . |
| 128278 | 5/1932 | Fed. Rep. of Germany . |
| 2352679 | 4/1975 | Fed. Rep. of Germany . |
| 1162286 | 9/1958 | France . |
| 922743 | 4/1963 | United Kingdom . |

*Primary Examiner*—Stanley N. Gilreath

*Attorney, Agent, or Firm*—Anthony J. Casella; Gerald E. Hespos

[57] ABSTRACT

Cable is wound on to a spool (2) comprising a longitudinally extending barrel (3) and a flange (4) extending from the barrel at one end thereof. At an ejection station the spool (2) is separated from the wound cable to leave a coil of cable (1). A removable flange (5), of a larger diameter than the spool flange (4), is placed over the barrel of the spool prior to winding. Subsequent removal of the spool (2) leaves a coil of cable (1) resting on the flange (5). An ejection station for separating the spool (12) from the wound cable is also described.

11 Claims, 3 Drawing Figures

COIL FORMING METHOD

This application is a continuation of application Ser. No. 746,182 filed on June 18, 1985, now abandoned.

This invention relates to a method of forming a coil of electric cable, electric conductor, or other flexible elongate member (hereinafter, for convenience, referred to as "cable").

According to the present invention, a method of forming a coil of cable comprises presenting to winding apparatus a spool comprising a longitudinally extending barrel and a flange extending away from the barrel at one end of the barrel; winding a predetermined length of cable onto the spool; removing the wound spool from the winding apparatus; and presenting the wound spool to an ejection station which separates the spool from the wound cable to leave a coil of cable.

The winding apparatus is preferably as described in published European patent application No. EP 0174066 which corresponds to U.S. patent application Ser. No. 746,108 filed by the applicant herein on June 18, 1985, both of which claim priority upon U.K. patent application No. 8415732 filed in Britain on June 20, 1984. and this invention has particular application when used with the apparatus described therein.

However, it will be understood that the method and apparatus claimed herein can be employed with other known winding apparatus, including, for example, even the manual winding of a cable onto a spool.

Preferably a removable flange is placed on the spool, next to the spool flange, before winding is started. At the ejection station, the removable flange is separated from the spool with the coil to leave the coil resting on the removable flange. The removable flange is preferably of steel. The removable flange preferably has a larger diameter than the spool flange.

At the ejection station, the spool is preferably positioned with the longitudinal axis of the barrel substantially vertical and with the wound cable (or, where present, the removable flange) resting on a surface which has an aperture, and the spool is pushed or pulled through the aperture to leave the coil (and removable flange) on the surface, or the spool is secured and the surface is moved upwards relative to the spool to separate the coil (and removable flange) from the spool. The aperture is preferably circular, and the centre of the aperture is preferably aligned with the longitudinal axis of the barrel before the spool is removed. The aperture is preferably closed by a movable plate which has a recess into which the flange of the spool fits for locating the wound spool at the ejection station. As the spool is pushed or pulled through the aperture the plate moves with the spool. The plate is preferably moved back to its position in the aperture by hydraulic means.

The barrel of the spool is preferably hollow and open at both ends. In this case, the ejection station preferably comprises spool removal means comprising a cylinder which can pass into the barrel from the flanged end of the spool, the cylinder having a centrally positioned piston mounted therein, the piston being movable relative to the cylinder and acting on at least two spring-loaded fingers mounted on the cylinder, the fingers being movable by the piston between two positions, a first where the fingers engage the barrel for securing the spool and a second where the cylinder can pass freely along the barrel. Each finger preferably has an outwardly extending ledge which can engage the end of the barrel remote from the flange, or a circumferentially extending, inwardly projecting, ridge (which may or may not be continuous) on the inner surface of the barrel. Preferably each finger is pivotally mounted on the cylinder, and preferably at or adjacent the end of the cylinder which passes into the barrel. The spring-loading is preferably such that the spring acts to move its respective finger from the first to the second position. Preferably there are four fingers equidistantly spaced around the cylinder. The piston preferably has a tapered end which acts on a corresponding surface on the fingers such that as the piston moves along the cylinder, the fingers are moved between their first and second positions. Preferably the piston is pneumatically actuated. The cylinder is preferably mounted on a second movable plate, at the end of the cylinder which does not enter the barrel. The pneumatic actuating means (where present) for the piston is preferably also mounted on the second plate. Movement of the second plate causes the cylinder to pass into the barrel. The second plate is preferably moved by an arrangement comprising a longitudinally extending column having a screw-threaded outer surface, the column being attached to the second plate; and a rotatable ball screw which engages the threaded surface of the column such that rotation of the ball screw about the longitudinal axis causes movement of the column along its longitudinal axis, and hence movement of the second plate. The ball screw is preferably rotated by a motor driven belt and pulley arrangement. Alternatively, the second plate may be moved by pneumatic means.

Alternatively, at the ejection station, the spool may be pushed from the coil by means acting on the end of the barrel remote from the flanged end. Preferably the ejection station is controlled by a programmable controller (e.g. a microcomputer and/or microprocessor).

This invention also includes apparatus for carrying out the method described herein. In particular apparatus for forming a coil of cable comprises winding apparatus for winding a predetermined length of cable on to a spool, and means for removing the spool from the winding apparatus, the spool comprising a longitudinally extending barrel and a flange extending away from the barrel at one end of the barrel, and means for separating the spool from the wound cable to leave a coil of cable.

One embodiment of the invention will now be described, by way of example only, with reference to the accompanying drawings in which.

Figure 1:
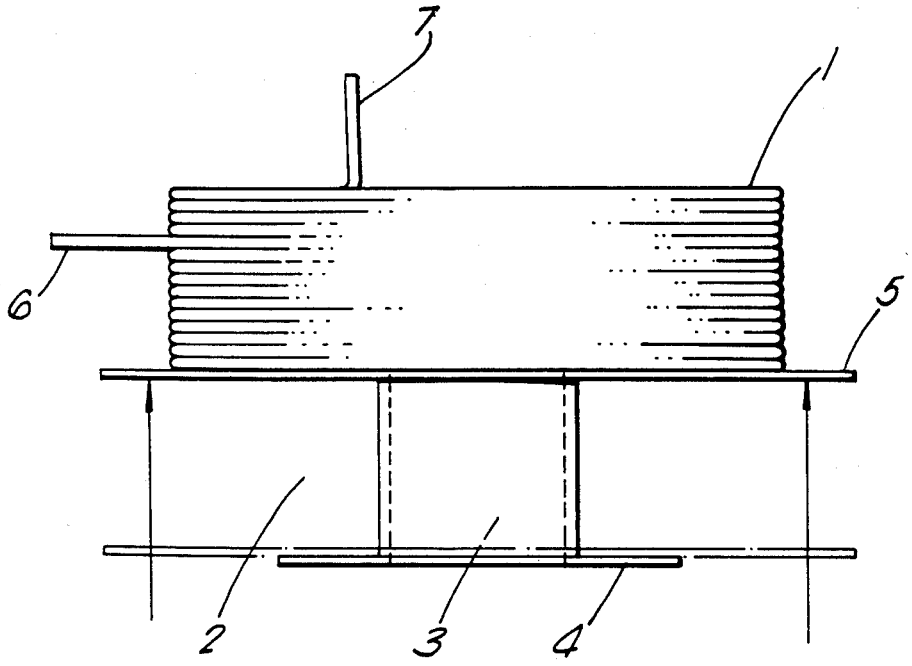
FIG. 1 is a schematic view of a coil of cable being formed in accordance with the invention.

Referring to FIG. 1 there is shown a coil of cable, the coil 1 having been wound on to a spool shown generally at 2. The spool 2 comprises a cylindrical barrel 3 and a spool flange 4 extending from the spool at the lower end thereof. Before winding of the coil 1, a removable flange 5 has been placed on to the spool 2 over the barrel 3 to rest on the spool flange 4. With the ends 6, 7 of the cable safely secured, the spool 2 may be separated from the coil 1 to leave the coil resting on the removable flange 5.

Figure 2:
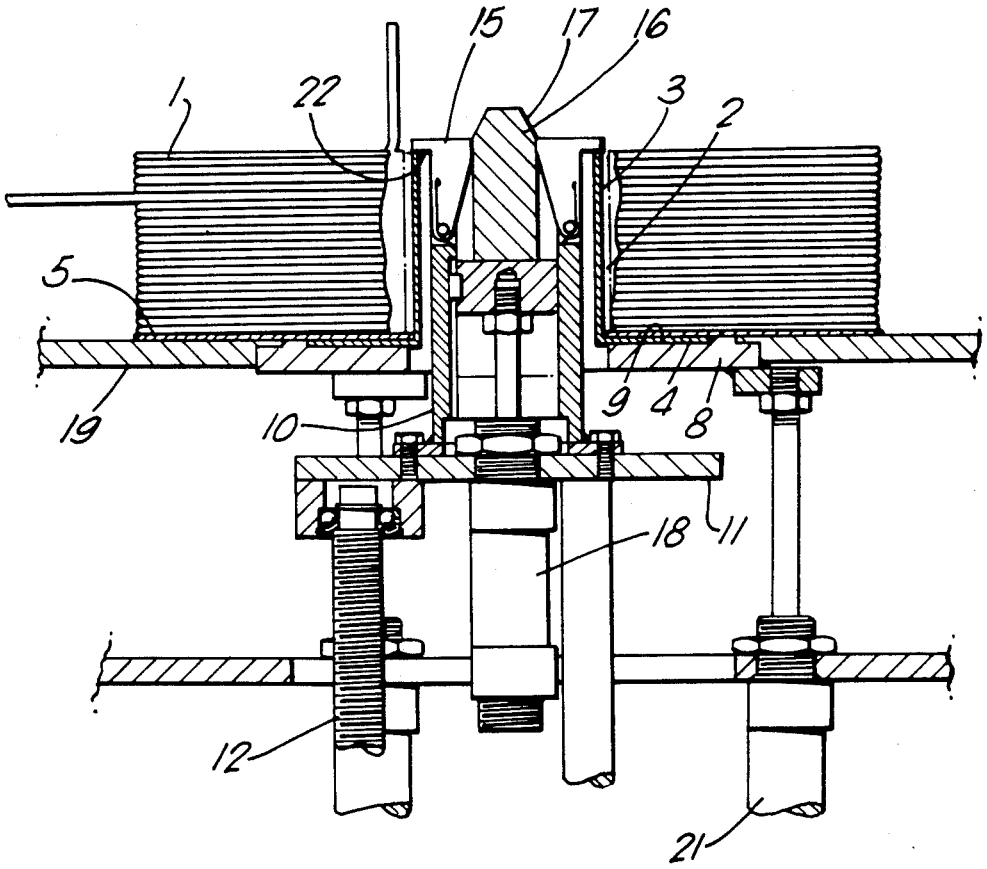
FIG. 2 is a sectional elevation of an ejection station for removing a spool from the coil of cable.

FIG. 2 shows the coil 1 resting on the removable flange 5 at the ejection station. The spool 2 is located on movable plate 8 with the spool flange 4 received in a recess 9 therein. The plate 8 forms a part of a flat surface 19 being received within a circular aperture 20, the plate being movable with respect to the surface by means of a pneumatic cylinder 21. A cylinder 10, fixedly attached to a further plate 11, is movable into the hollow barrel 3 of the spool 2, by means of a worm drive on a column 12. The column 12 is rotated by a belt 13 and pulley 14 as shown in FIG. 3.

Figure 3:
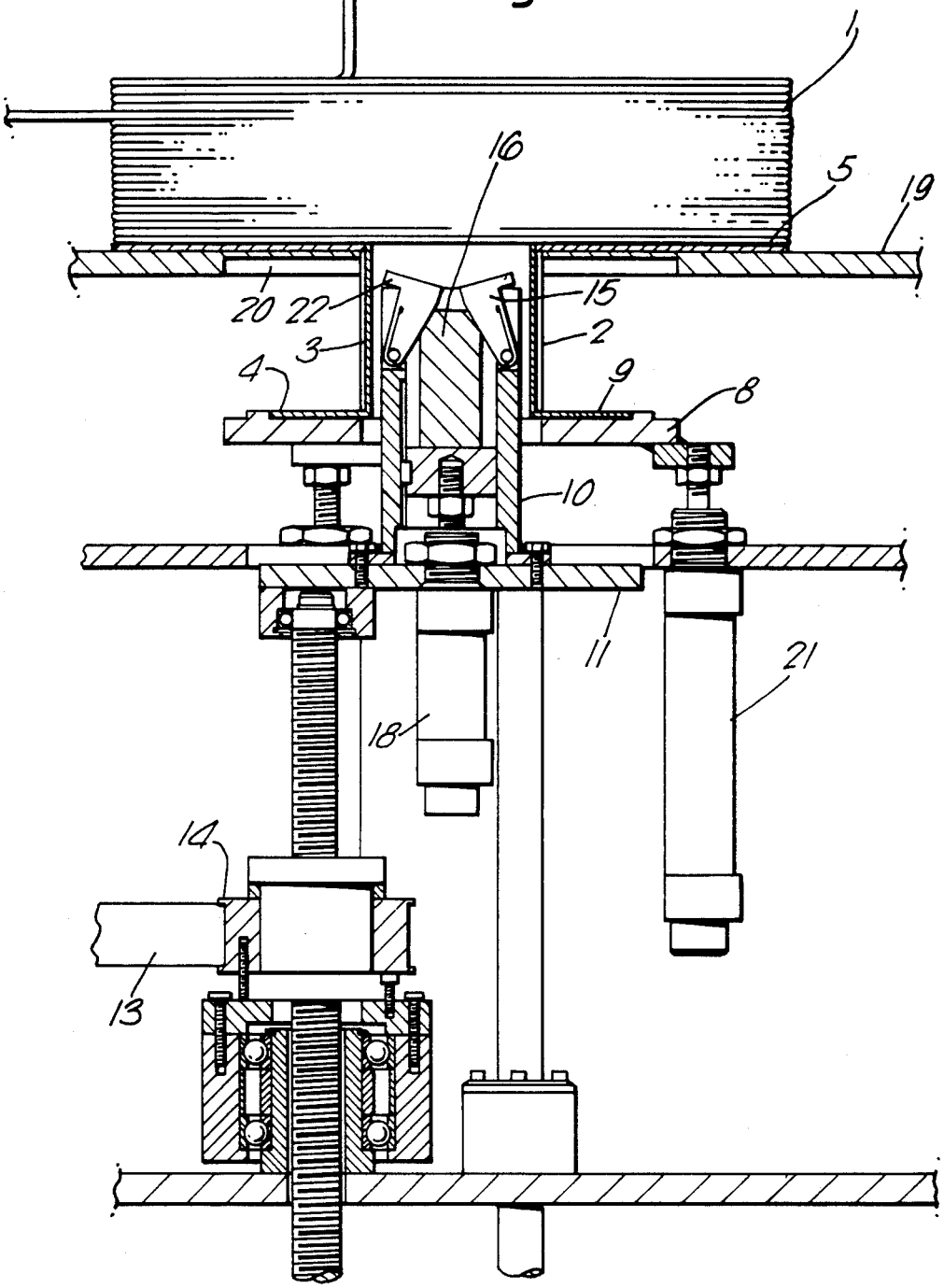
FIG. 3 is a sectional elevation of the ejection station of FIG. 2, the station having separated the spool from the cable.

Pivotally attached to the cylinder 10 are fingers 15 resiliently biased into a retracted position as shown in FIG. 3 where they lie within the radial extent of the cylinder 10. The fingers 15 are movable into an extended position as shown in FIG. 2 by the movement of a piston 16, reciprocally mounted within the cylinder 10 and having a tapered, finger-contacting head 17. The piston is driven for movement by means of a pneumatic cylinder 18.

In use a wound coil with its ends secured is presented to the ejection station. The cylinder 10 is then moved into the barrel 3 of the spool 2 by the worm drive. Once inserted the pneumatic cylinder 18 operates the piston 16 to open the fingers 15 such that a ledge 22 provided thereon contacts the top of the barrel 3. The cylinder is then moved downwardly with respect to the coil 1, and at the same time the pneumatic cylinder 21 causes the plate 8 to drop relative to the surface 19, thereby separating the spool 2 from the coil of cable 1. The coil 1 thus remains resting on the flange 5 and the surface 19.

Once the spool 2 and the coil 1 are separated one from the other, the fingers 15 are moved to their retracted position as shown in FIG. 3, and the cylinder is withdrawn from the barrel of the spool, allowing both the spool and coil to be separately removed from the machine.

I claim:

1. A method of forming a coil of cable comprising the steps of: providing a spool comprising a longitudinally extending barrel and a spool flange extending away from the barrel and fixedly connected to one end of the barrel; placing a removable flange over the barrel and adjacent the spool flange; presenting said spool to a winding apparatus; winding a predetermined length of cable on to the spool; removing the wound spool from the winding apparatus; presenting the wound spool to an ejection station; and separating the spool from the wound cable and the removable flange to leave the wound cable resting on the removable flange.

2. A method according to claim 1 wherein the removable flange is of a larger diameter than the spool flange.

3. A method according to claim 1 further including the step of providing a surface having an aperture therein and wherein the separating step comprises placing a portion of the removable flange on to the surface and moving the spool and the surface one relative to the other such that the spool passes through the aperture to separate the spool from the removable flange and the wound cable thereon.

4. A method according to claim 3 including the steps of providing a movable plate, locating the spool flange on the movable plate and wherein the separating step comprises moving the movable plate and the spool relative to the removable flange and the wound cable to separate the spool from the wound cable and the removable flange.

5. A method according to claim 1 including the step of providing at the ejection station one or more fingers which are movable between a first position wherein the one or more fingers engage the barrel, and a second position where they can pass freely therealong and wherein the separating step comprises: moving the fingers to the second position, inserting the fingers into the barrel after presenting the spool to the ejection station, moving the fingers to the first position and moving the fingers relative to the wound cable and the removable flange to separate the spool form the wound cable and the removable flange.

6. In combination, a spool and an apparatus for separating a coil of cable from the spool, the spool of said combination comprising:

a removable flange having an aperture extending therethrough;

an elongated spool barrel of generally constant outer cross section along its length, said cross section being dimensioned to enable said spool barrel to pass through said aperture in said removable flange; and the apparatus of said combination comprising;

means for selectively effecting relative movement between said removable flange and said spool barrel such that in a first relative position said spool barrel extends through said aperture and from said removable flange, and such that in a second relative position, said spool barrel is substantially free of said coil and substantially spaced from said removable flange.

7. An apparatus as in claim 6 further comprising a flange fixedly connected to an end of said spool barrel, said flange defining an area larger than the area of said aperture.

8. An apparatus as in claim 7 wherein the spool barrel is substantially hollow and wherein the means for effecting relative movement comprises finger means movable within said hollow spool barrel for selectively engaging said spool barrel and urging said spool barrel into the second position.

9. An apparatus as in claim 8 wherein said finger means are operative to engage said spool barrel at the end thereof opposite the fixedly connected spool flange.

10. An apparatus as in claim 9 wherein said means for effecting relative movement further comprises a cylinder selectively movable within said spool barrel, said finger means comprising at least one finger pivotally mounted to said cylinder and configured to be selectively contacted by said piston and urged by said piston into position for engaging said spool barrel.

11. A method of forming a coil of cable comprising the steps of: providing a spool comprising a longitudinally extending barrel and a spool flange fixedly connected to one end of the barrier; providing a removable flange having an aperture extending therethrough dimensioned to receive the spool barrel; moving the spool barrel through the aperture in the removable flange, such that the removable flange is generally adjacent the spool flauge; winding a predetermined length of cable around the spool barrel and on the removable flange; and separating the spool from the wound cable and the removable flange to leave the wound cable on the removable flange.

* * * * *